US008579108B2

(12) United States Patent
Tanbo et al.

(10) Patent No.: US 8,579,108 B2
(45) Date of Patent: Nov. 12, 2013

(54) CIGARETTE PACKAGE

(75) Inventors: Hitoshi Tanbo, Tokyo (JP); Hiroyuki Yamashita, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 13/334,858

(22) Filed: Dec. 22, 2011

(65) Prior Publication Data

US 2012/0111746 A1 May 10, 2012

Related U.S. Application Data

(63) Continuation of application No. PCT/JP2009/062752, filed on Jul. 14, 2009.

(51) Int. Cl.

| | |
|---|---|
| ***A24F 15/00*** | (2006.01) |
| ***B65D 85/10*** | (2006.01) |
| ***B65D 85/12*** | (2006.01) |

(52) U.S. Cl.

USPC ..... 206/268; 206/242; 206/273; 229/87.13

(58) Field of Classification Search

USPC ..... 206/268, 259, 261, 530, 531, 274, 242; 229/87.13

See application file for complete search history.

(56) References Cited

U.S. PATENT DOCUMENTS

| | | | | |
|---|---|---|---|---|
| 5,515,965 | A * | 5/1996 | Boldrini et al. | 206/264 |
| 6,199,687 | B1 | 3/2001 | Tambo et al. | |
| 6,244,442 | B1 * | 6/2001 | Inoue et al. | 206/531 |
| 7,353,940 | B2 * | 4/2008 | Sendo | 206/268 |
| 7,870,953 | B2 * | 1/2011 | Tanbo et al. | 206/268 |
| 8,365,978 | B2 * | 2/2013 | Yoshimura et al. | 229/87.05 |
| 2005/0241967 | A1 | 11/2005 | Sendo | |
| 2006/0169605 | A1 * | 8/2006 | Tambo | 206/268 |
| 2006/0231431 | A1 * | 10/2006 | Tambo | 206/268 |
| 2008/0006544 | A1 * | 1/2008 | Bouno et al. | 206/268 |
| 2008/0011627 | A1 * | 1/2008 | Tanbo | 206/268 |

(Continued)

FOREIGN PATENT DOCUMENTS

| | | |
|---|---|---|
| CN | 101360665 A | 2/2009 |
| JP | 11-49134 A | 2/1999 |

(Continued)

OTHER PUBLICATIONS

International Search Report for PCT/JP2009/062752 dated Aug. 18, 2009.

(Continued)

*Primary Examiner* — Luan K Bui
*Assistant Examiner* — Rafael Ortiz
(74) *Attorney, Agent, or Firm* — Birch, Stewart, Kolasch & Birch, LLP

(57) ABSTRACT

A cigarette package includes an inner wrapping body formed by folding an inner wrapper having a film material ply sandwiched between a paper ply and a heat seal material ply into a substantially cuboidal shape, including substantially-parallel two half-cut lines extending from a top face into an upper portion of a front face of an inner boxy body each formed of a cut penetrating through the paper ply into the film material ply, a cut line formed of a cut penetrating through an outer layer constituting an overlap on the front face of the inner box body, at an upper location. A heat-sealed part is formed to surround the cut line by heat-sealing inner and outer layers, wherein an outer side of the outer layer is bonded to an inner side of a front lid, in a section above the cut line within a region surrounded by the heat-sealed part.

8 Claims, 7 Drawing Sheets

(56) References Cited

U.S. PATENT DOCUMENTS

| | | | | |
|---|---|---|---|---|
| 2009/0038965 | A1 | 2/2009 | Tanbo et al. | |
| 2010/0072104 | A1 * | 3/2010 | Kohl | 206/531 |

FOREIGN PATENT DOCUMENTS

| | | | |
|---|---|---|---|
| JP | 2005-280848 | A | 10/2005 |
| WO | WO 2004/064550 | A1 | 8/2004 |
| WO | WO 2005/007538 | A1 | 1/2005 |
| WO | WO 2006/075624 | A1 | 7/2006 |
| WO | WO 2007/069515 | A1 | 6/2007 |

OTHER PUBLICATIONS

Written Opinion of the International Searching Authority dated Aug. 18, 2009.

* cited by examiner

CIGARETTE PACKAGE

CROSS REFERENCE TO RELATED APPLICATIONS

This application is a Continuation of PCT International Application No. PCT/JP2009/062752 filed on Jul. 14, 2009, which is incorporated by reference into the present application.

TECHNICAL FIELD

This invention relates to a package comprising an outer box and an inner wrapping body placed therein, more specifically, a cigarette package.

BACKGROUND ART

A variety of packaging containers for holding items have been developed in consideration of the features of the items to be held. As a packaging container (cigarette package) for tobacco items, such as filtered cigarettes or cigarettes, a hinged-lid package is known.

As one type of the hinged-lid package, various kinds of tongue-lid packages, including a tongue-lid box disclosed in patent document 1, are proposed.

The known prior-art tongue-lid packages comprise an outer box body with an open top, a lid for openably closing the open top of the outer box body, and contents placed in the outer box body. The contents consist of a bunch of rod-shaped smoking items and an inner wrapping body covering the bunch. Commonly, the package of this type is further wrapped in a transparent film, where the film wrap is provided with a tear-open tape.

It is preferable to omit film-wrapping of the package in view of recently increasing demands for resource saving.

The film wrap is, however, provided to seal the package to prevent the packaged items from being affected by ambient air, specifically, moisture, odors, etc. contained in the ambient air. Thus, omission of the film wrapping may lead to quality deterioration of the packaged items.

PRIOR-ART DOCUMENT

Patent Document

Patent document 1: Japanese Patent Application Laid-open No. Hei 11-49134 Publication

DISCLOSURE OF THE INVENTION

Problem to be Solved by the Invention

The present invention has been made in consideration of the aforementioned prior art. An object of the present invention is to provide a cigarette package having sufficient sealing performance for the packaged items, even without film wrapping.

Means for Solving the Problem

In order to achieve the above object, the invention recited in claim 1 is a cigarette package, comprising: a substantially cuboidal outer box body having an open top and a cutout formed in a front wall, in an upper region, the cutout connecting to the open top; a lid body rotatably joined to a rear edge of the open top by a lid hinge, the lid body including an upper lid for covering the open top and a front lid for covering said upper region of the front wall of the outer box body with the cutout formed in; an inner wrapping body placed inside the outer box body, the inner wrapping body including an inner box body with an overlap on a front face, at an upper location, formed by folding a substantially rectangular inner wrapper having a film material ply sandwiched between a paper ply and a heat seal material ply into a substantially cuboidal shape; the inner wrapping body including substantially-parallel two opening developing lines extending from a top face into an upper portion of the front face of the inner box body, an opening start line extending in an outer layer constituting said overlap and connecting to the opening developing lines at both ends, and a heat-sealed part formed to surround the opening start line, by heat-sealing an inner and outer layers constituting said overlap, on the front face of the inner box body, at the upper location; an outer side of the outer layer of the overlap being bonded to an inner side of the front lid, in a section above the opening start line within a region surrounded by the heat-sealed part, and the opening developing lines each being formed by making a cut in the inner wrapper in a manner that the cut does not penetrate through the inner wrapper.

The invention recited in claim 2 is a cigarette package of the type recited in claim 1 wherein the opening start line is formed by making a cut through the inner wrapper in a region which becomes the outer layer of said overlap.

The invention recited in claim 3 is a cigarette package of the type recited in claim 1 or 2 wherein the opening start line extends substantially in V-shape.

Effect of the Invention

In the invention recited in claim 1, the heat-sealed part formed to surround the opening start line by heat-sealing the outer and inner layers of the overlap reliably prevents air from passing into or out of the inner wrapping body through the opening start line. The opening developing lines, each formed by making a cut in the inner wrapper in a manner that the cut does not penetrate through the inner wrapper, do not impair the sealing performance of the inner wrapping body. Thus, although the outer box body is not wrapped in film, the inner wrapping body is sealed, so that the packaged items are protected against external influence. In the section above the opening start line within the region surrounded by the heat-sealed part, the outer side of the outer layer of the overlap is bonded to the inner side of the front lid. Thus, when the lid body is rotated, the part of the outer layer above the opening start line is pulled by the rotating lid body, which causes the inner wrapper to tear along the opening developing lines, and thus enables removal of items inside through the open top. In sum, only by rotating the lid body, the sealed inner wrapping body is opened to allow removal of items inside. The inner wrapping body is formed from an inner wrapper only with an opening start line and opening developing lines formed therein. This allows inner wrappers to be prepared in the form of rolls, leading to increased productivity.

In the invention recited in claim 2, the opening start line is formed by making a cut through the inner wrapper in a region which becomes the outer layer of the overlap. This helps easy tearing of the inner wrapper from the opening start line along the opening developing lines when the lid body is rotated.

In the invention recited in claim 3, the opening start line extends substantially in V-shape. This leads to reduction in force applied to rotate the lid body, and allows the inner wrapping body to be opened neatly along the half-cut lines.

MODE OF CARRYING OUT THE INVENTION

With reference to the drawings attached, a cigarette package according to the present invention will be described below. The description will be given taking a tongue-lid package, a specific type of the hinged-lid package, as an example. The present invention is however applicable to common hinged-lid packages.

Figure 1:
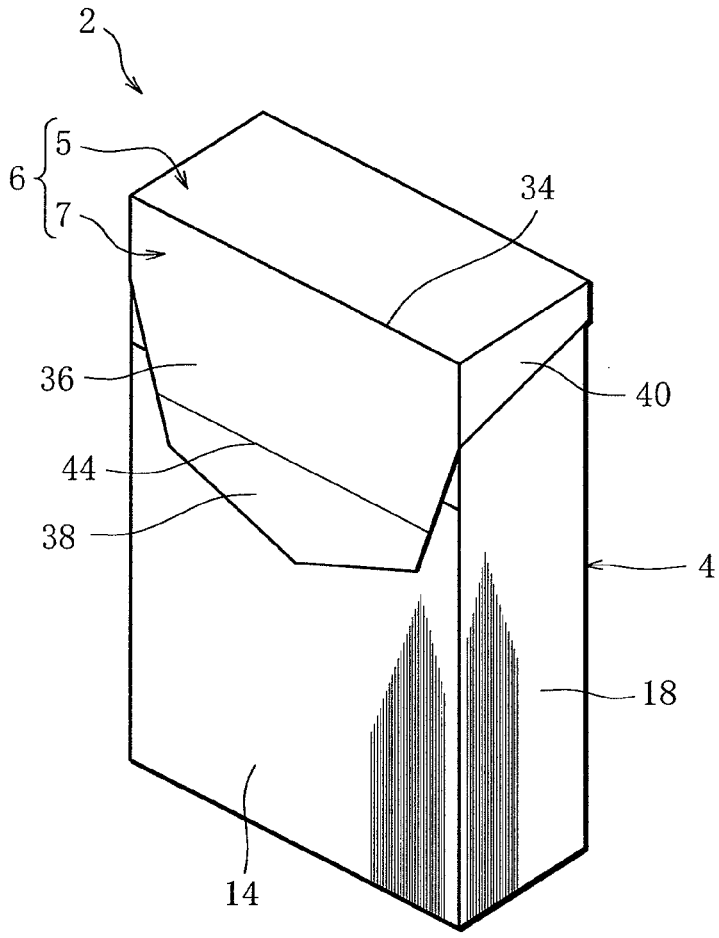
FIG. 1 is a perspective view showing an embodiment of a tongue-lid package before opened.
Figure 2:
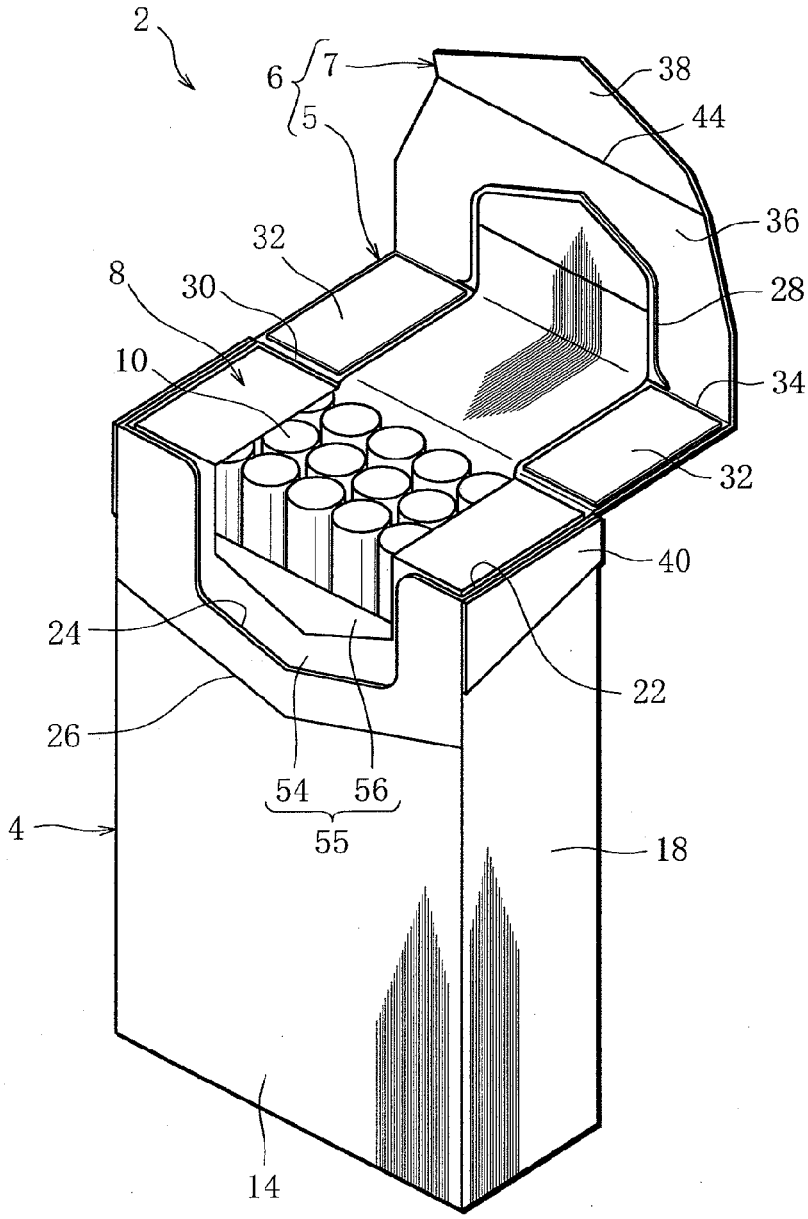
FIG. 2 is a perspective view showing the embodiment of the tongue-lid package with a tongue lid in an open position.
Figure 3:
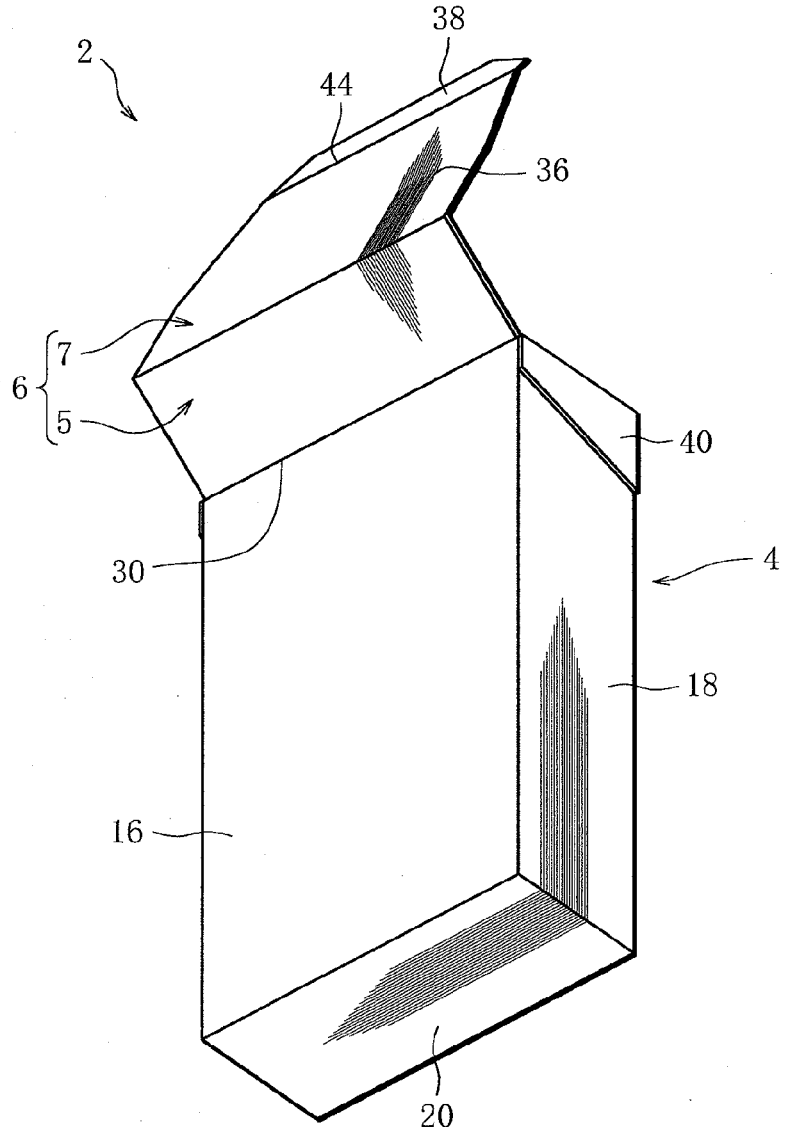
FIG. 3 is a perspective view showing the embodiment of the tongue-lid package with the tongue lid in the open position, as viewed from the rear bottom side.
Figure 4:
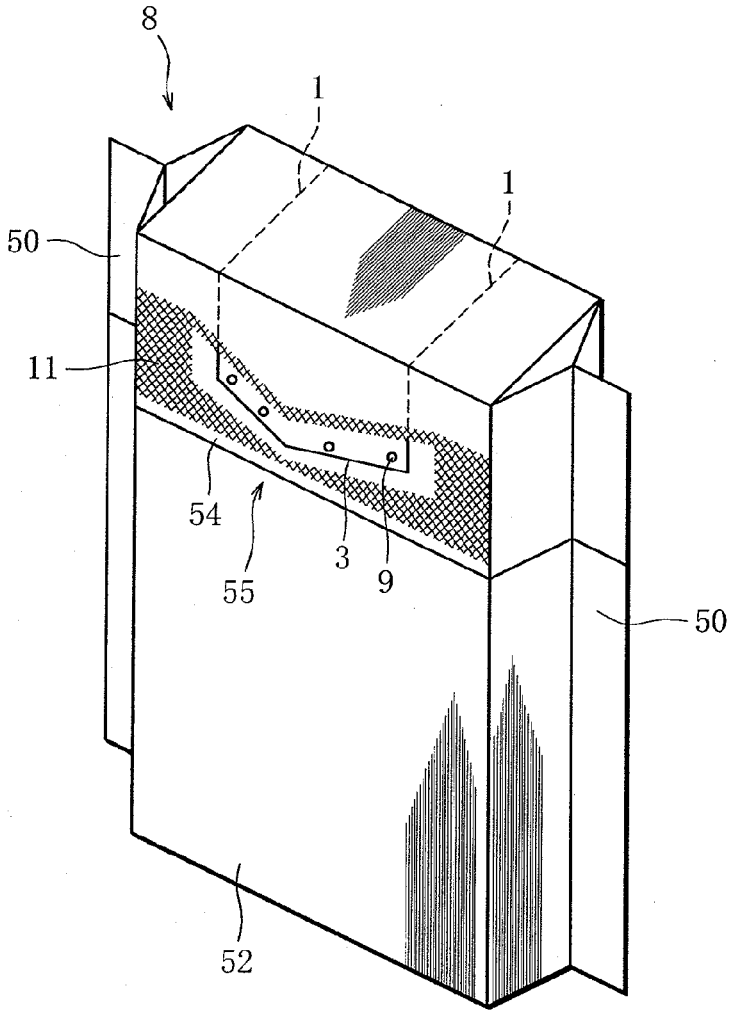
FIG. 4 is a perspective view showing in what state an inner wrapping body is within the tongue-lid package in the state shown in FIG. 1.
Figure 5:
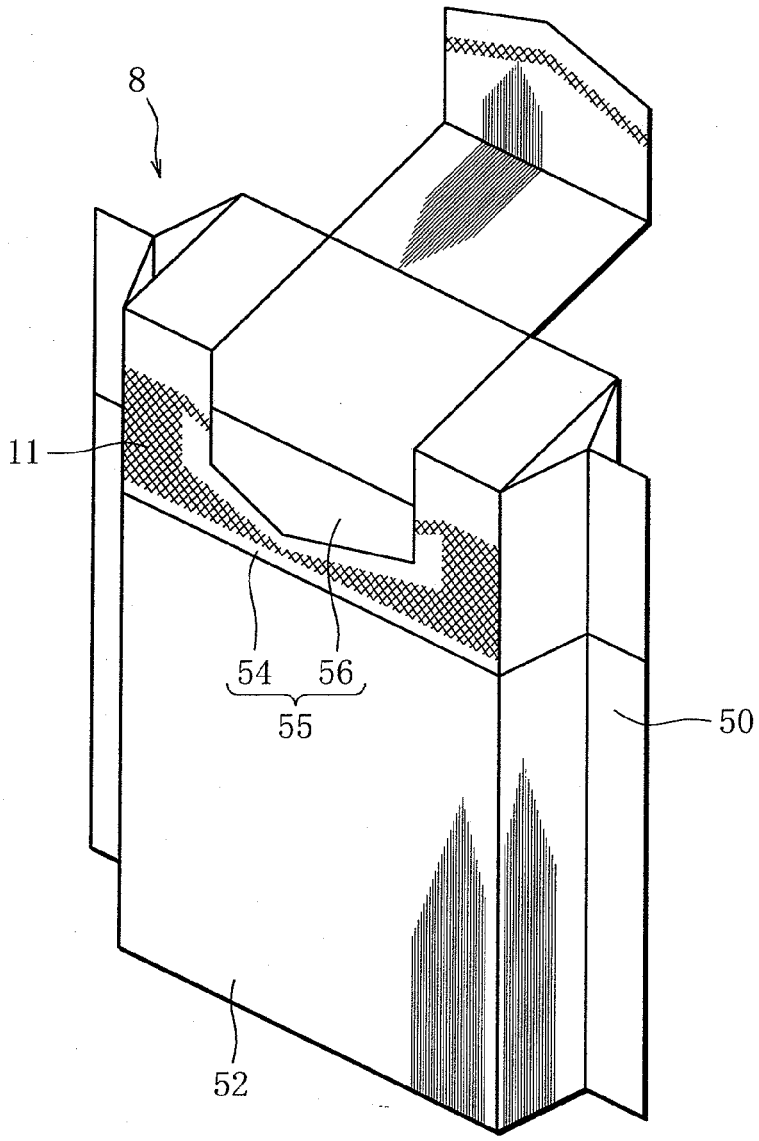
FIG. 5 is a perspective view showing in what state the inner wrapping body is within the tongue-lid package in the state shown in FIG. 2.

FIGS. 1 to 3 show an embodiment of a tongue-lid package. FIGS. 4 and 5 are schematic perspective views showing in what states an inner wrapping body is within the package in the states shown in FIGS. 1 and 2, respectively.

The cigarette package 2 comprises an outer box body 4, a tongue lid 6, or lid body, joined to the outer box body 4, and an inner wrapping body 8 placed inside the outer box body 4. Contents, or tobacco items 10 are enclosed in the inner wrapping body 8. The tongue lid 6 includes a lid 5, or upper lid and a tongue 7, or front lid.

The outer box body 4 is substantially a cuboid with an open top 22, and has a size suited to receive one inner wrapping body 8. More specifically, the outer box body 4 comprises a front wall 14, a rear wall 16 opposite the front wall 14, having the same size as the front wall 14, a pair of side walls 18 connecting the side edges of the front and rear walls 14, 16 at either side, and a bottom wall 20 connected to the bottom edges of the front, rear and side walls 14, 16, 18.

The front wall 14 has a cutout 24 in an upper middle region. The cutout 24 connects to the open top 22. The cutout 24 is substantially rectangular in shape, although a lower edge bends like a flattened V. The front wall 14 also has an insertion slit 26, below the cutout 24. The insertion slit 26 extends from one side edge to the other of the front wall 14, along the lower edge of the cutout 24, and thus, bending like a flattened V, similarly. The cutout 24 is formed by separation of a separation piece 28 of the shape corresponding to the cutout 24 from the front wall 14, which is caused when the tongue-lid 6 is first opened. Thus, in the package 2 immediately after manufacture, the separation piece 28 exists as a section delimited by a separation line, in the upper middle region of the front wall 14 in which the cutout 24 is to be formed. The separation line consists of a row of perforations, for example, where the adjacent perforations may be equal or different in length. The separation piece 28 can be easily torn off the front wall 14 along the separation line.

The rear wall 16 has a top edge functioning as a lid hinge 30. The tongue-lid 6 is rotatably joined to the rear wall 16 by the lid hinge 30. The lid hinge 30 extends between the tops of the rear edges of the side walls 18.

The lid 5 is in a rectangular shape of the same size as the open top of the outer box body 4, and provided with rectangular inner top flaps 32 bonded to the inner surface thereof, on either side. Each inner top flap 32 is separably joined to the top edge of the corresponding side wall 18 by a separation line. In the package 2 immediately after manufacture, the inner top flaps 32 bonded to the inner surface of the lid 5 overlie the top face of the inner wrapping body 8, on either side. When the tongue-lid 6 is first opened, each inner top flap 32 is separated from the corresponding side wall 18 along the separation line, being held on the inner surface of the lid 5. These inner top flaps 32 reinforce the lid 5 and improve formability of the outer box body 4.

The tongue 7 is joined to the lid 5 by a tongue hinge 34.

As the tongue-lid 6 is rotated on the lid hinge 30, the open top 22 of the outer box body 4 becomes exposed or covered with the lid 5. With the lid 5 covering the open top 22, the tongue 7 of the tongue-lid 6 overlies the front wall 14.

More specifically, the tongue 7 comprises a tongue body 36 and an insertion piece 38. The tongue body 36 has a size enough to cover the cutout 24 or separation piece 28 in the front wall 14. More specifically, the tongue body 36 is substantially in a rectangular shape having a tapering distal portion, and rotatably joined to the front edge of the lid 5 by a tongue hinge 34.

The insertion piece 38 is rotatably joined to the distal end of the tongue body 36 by a hinge 44. The insertion piece 38 comprises a proximal portion continuing from the distal end of the tongue body 36 and a triangular distal portion continuing from the proximal portion. Each side edge of the proximal portion of the insertion piece 38 continues from the corresponding side edge of the distal portion of the tongue body 36 in a line, so that the tongue 7 as a whole has a shape tapering toward the distal end, which makes it easy to insert the insertion piece 38 into the aforementioned insertion slit 26 in the outer box body 4.

In the package 2 being manufactured, the tongue body 36 includes lugs 40 substantially in the shape of a truncated triangle, joined to the respective side edges of the proximal portion by a separation line. In the package 2 immediately after manufacture, each lug 40 is bonded to the corresponding side wall 18 of the outer box body 4 to overlie an upper part of the side wall 18. When the tongue-lid 6 is first opened, each lug 40 is separated from the tongue body 36 along the separation line to stay on the upper part of the side wall 18. The lugs thus reinforce the open top 22, and keep the tongue 7 in close contact with the front wall 14 of the outer box body 4, thereby maintaining improved sealing performance of the package until the tongue lid 6 is first opened after manufacture of the package.

As shown in FIG. 4, the inner wrapping body 8 is substantially a cuboid, and in the illustrated example, the tobacco items 10 inside are twenty of 85 mm-long "king-sized" filtered cigarettes.

The inner wrapping body 8 is formed from a rectangular inner wrapper (see FIG. 6), which is folded into an inner box body 13 which airtightly encloses a bunch of tobacco items 10. More specifically, the inner wrapper 12 is first wrapped around the bunch along the length thereof, where the opposite transverse edge portions of the inner wrapper are brought together, to form an overlap 55 on the bunch, at an upper location. Of the edge portions forming the overlap 55, one forms an outer layer 54 and the other an inner layer 56 of the overlap. The overlap 55 is formed from one side to the other of the inner wrapper 12. Then, as seen in FIG. 5, the overlap 54 is folded down toward the bottom of the bunch to overlie the front face 52 of the inner box body 13 formed by wrapping the inner wrapper around the bunch.

The inner wrapper 12 wrapped around the bunch with the overlap 55 projects from either side of the bunch, thus forming a rectangular projection at either side of the bunch. Each rectangular projection is gusset-folded at the top and the bottom, and then folded to cover the side of the bunch, and thus, forms a side face of the inner box body 13. Specifically, each rectangular projection is folded with its longitudinal edge portions brought together, to form a longitudinal seal 50. The longitudinal seal 50 extends longitudinally from the top to the bottom of the inner box body 13, at the center of the side face of the inner box body 13. The longitudinal seal 50 is then folded toward, for example the front face 52 of the inner box body 13 to overlie the side face of the inner box body 13. By this, the forming of the inner wrapping body 8 is completed.

More specifically, the overlap 55 runs across one of the longitudinal seals 50, then across the inner box body 8 and then across the other longitudinal seal 50. The end portions of the overlap 55 overlie the longitudinal seals 50, respectively.

As seen in FIG. 4, two parallel half-cut lines (opening developing lines) 1 are formed to extend from the top face into an upper portion of the front face of the inner box body 13. Each half-cut line 1 is formed by making a cut not to penetrate through all the plies constituting the inner wrapper 12 (see FIG. 6), which will be described later. Further, a cut line (opening start line) 3 is formed to connect the two half-cut lines 1. More specifically, the cut line 3 connects to the half-cut lines 1 at both ends, and extends substantially in V-shape. In the following description, it is assumed that the cut line 3 is formed by making a cut through the inner wrapper 12. The cut line 3 may however be formed by making a cut not to penetrate through the inner wrapper, as is the case with the half-cut lines 1.

The inner and outer layers 56, 54 constituting the aforementioned overlap 55 are partly heat-sealed. The heat-sealed part 11 is formed to surround the cut line 3. More specifically, the heat-sealed part 11 extends from one side edge to the other of the front face of the inner box body 13 in a manner surrounding the cut line 3. The heat-sealed part thus formed can reliably prevent air from passing into or out of the inner wrapping body 8 through the cut line 3. As mentioned above, the half-cut lines 1 connected to the cut line 3 are the cuts not penetrating through the inner wrapper 12. This feature, coupled with the heat-sealed part 11 and the longitudinal seals 50, renders the inner wrapping body 8 sealed against air. The contents (tobacco items 10) inside the inner wrapping body 8 can therefore be protected from external influence without film-wrapping of the outer box body 4.

In a section above the cut-line 3 within the region surrounded by the heat-sealed part 11, the outer side of the outer layer 54 of the overlap is bonded to the inner side of the tongue body 36 of the tongue 7, or front lid, with a bonding material 9. More specifically, at a plurality of locations along and above the cut line 3 (four locations in the depicted example), the outer side of the outer layer 54 of the overlap is bonded to the inner side of the separation piece 28 fixed to the inner side of the tongue body 36, with the bonding material 9. Thus, as the tongue lid 6, or lid body is rotated as depicted in FIG. 2, the part of the outer layer 54 above the cut line 3 is pulled, so that the portion of the heat sealed part 11 above the cut line 2 separates and the inner wrapper 12 tears along the half-cut lines 1. The inner wrapper 12 is thus opened in a manner that its portion surround by the half-cut lines 1 and the cut line 1 is rotated on the top rear edge of the inner box body 13, as depicted in FIG. 5, so that the contents (tobacco items 10) can be removed from inside the inner box body 13 through the open top. In other words, only by rotating the tongue lid 6, the sealed inner wrapping body 8 is opened so that the tobacco items 10 can be removed therefrom. In the prior art, it is mainstream to provide lines consisting of slit perforations in the region where the half-cut lines 1 are provided. Replacing the slit perforation lines with the half-cut lines 1 not penetrating through a heat seal material 19 ply can not only ensure sealing performance but also increase ease of opening.

In addition, the cut line 3 of substantially V-shape leads to reduction in force applied to rotate the tongue lid 6, and allows the inner wrapping body 8 to be opened neatly along the half-cut lines 1.

Figure 6:
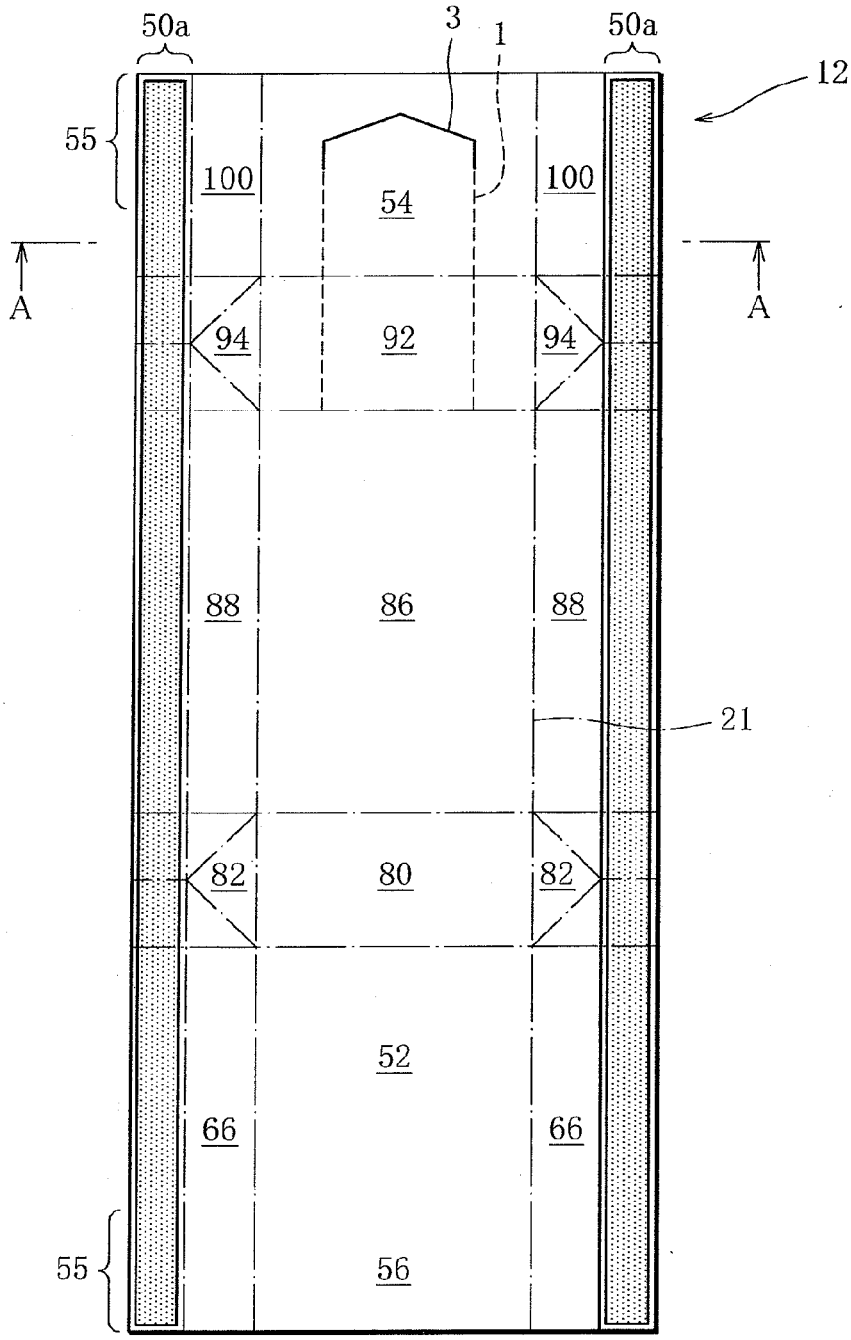
FIG. 6 is a diagram showing an inner wrapper unfolded with the inner side up.
Figure 7:
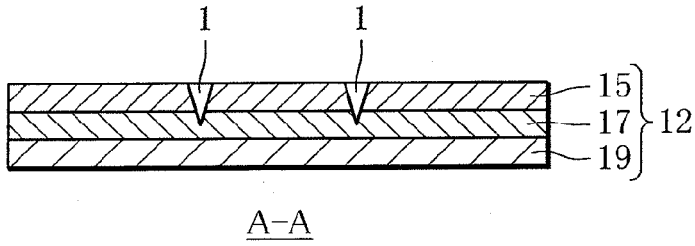
FIG. 7 is a cross-sectional view along line A-A in FIG. 6.

FIG. 6 is a diagram showing the inner wrapper unfolded with the inner side up, and FIG. 7 is a cross-sectional view along line A-A in FIG. 6.

The inner wrapper 12 is substantially rectangular in shape. Chain lines in FIG. 6 represent fold lines 21 produced in the inner wrapper 12 as a result of folding the inner wrapper 12 to enclose the contents, or bunch of tobacco items. As understood from this diagram, the sections of the inner wrapper 12 delimited by the fold lines 21 form the parts of the inner box body 13. As seen in FIG. 7, the inner wrapper 12 has a trilaminar structure comprising a paper 15 ply, a film material 17 ply and a heat seal material 19 ply. The film material 17 is PET (polyethylene terephrhalate), for example. The heat seal material 19 is a thermally-weldable film. The heat seal material 19 enables formation of the aforementioned heat sealed part 11 and longitudinal seals 50. The inner wrapper 12 is folded with the heat seal material 19 ply inside.

More specifically, the inner wrapper 12 includes an inner layer 56 section for constituting part of the front face 52 of the inner box body 13, a bottom section 80 for constituting the bottom face of the inner box body 13, a rear section 86 for constituting the rear face of the inner box body 13, a top section 92 for constituting the top face of the inner box body 13, and an outer layer 54 section to overlie the front face 52 of the inner box body 13. Further, to the left and right of the sections 56, 80, 86 92 and 54, side sections 66, 82, 94 and 100 for constituting the side faces of the inner box body 13 are joined.

As will be understood from the foregoing, the outer layer 54 section and the inner layer 56 section 56 are joined and made into the aforementioned overlap 55 by heat sealing. At the left as well as at the right, the side edge portion 50*a* is folded on itself and made into the aforementioned longitudinal seal 50 by heat sealing. As mentioned above, the end portions of the overlap 55 overlie the longitudinal seals 50, respectively.

As seen in FIG. 6, the aforementioned substantially V-shaped cut line 3 is formed in the outer layer 54 section. The two parallel half-cut lines 1 are formed to extend from the top section 92 into the outer layer 54 section. As seen in FIG. 7, each half-cut line 1 is formed of a cut penetrating through the paper 15 ply into the film material 17 ply, and thus, leaving part of the film material 17 ply and the heat seal material 19 ply intact. The depth of the cut forming the half-cut line 1 is however not restricted to the depicted example. The cut may be made to penetrate halfway into the paper 15 ply, or halfway into the heat seal material 19 ply. In sum, the cut needs to be made to leave part of the inner wrapper 12 intact. Up to what ply the cut is formed to extend is a matter of choice. The half-cut lines 1 thus formed do not allow air to pass through them. Incidentally, in FIG. 7, the half-cut lines 1 are represented in an exaggerated size for the sake of understandability. As will be understood from the foregoing, the sealed inner wrapping body 8 is formed from an inner wrapper 12 only with a cut line 3 and half-cut lines 1 formed therein. This allows inner wrappers 12 to be prepared in the form of rolls, leading to increased productivity. The inner wrappers 12 may however be prepared in the form of sheets. The half-cut lines 11 may penetrate through the paper 16 and film material 17 plies, leaving only the heat seal material 19 ply or part thereof intact.

The chain lines in the side sections 82, 94 indicate that these sections 82, 94 are gazette-folded as mentioned above.

The present invention is not restricted to the above-described embodiment, which can be modified in various ways. For example, the embodiment has been described with an example in which the package holds one pack containing 20 of king-sized tobacco items. The present invention is however applicable to the package holding one inner pack containing 20 of "super king-sized" tobacco items 95 mm long or so. The contents are not restricted to tobacco items, but can be other articles, including food items such as sweets. The present invention is applicable to packages for such articles.

EXPLANATION OF REFERENCE CHARACTERS

1: Half-cut line
2: Package
3: Cut line
4: Case body
5: Lid
6: Tongue-lid
7: Tongue
8: Inner wrapping body
9: Bonding material
10: Tobacco item
11: Heat-sealed part
12: Inner wrapper
13: Inner box body
14: Front wall
15: Paper
16: Rear wall
17: Film material
18: Side wall
19: Heat seal material
20: Bottom wall
21: Fold line
22: Open top
24: Cutout
26: Insertion slit
28: Separation piece
30: Lid hinge
32: Inner top flap
34: Tongue hinge
36: Tongue body
38: Insertion piece
40: Lug
44: Hinge
50: Longitudinal seal
52: Front face
54: Outer layer
56: Inner layer

The invention claimed is:

1. A package comprising:

a substantially cuboidal outer box having an open top and a to-be cutout portion separably formed in an upper region of a front wall thereof, the to-be cutout portion forming a cutout connecting with the open top when the to-be cutout portion is separated from the front wall of said outer box;

a tongue lid rotatably joined to a rear edge of the open top by a lid hinge, said tongue lid including a lid for covering the open top and a tongue for covering the upper region of the front wall of said outer box; and a substantially cuboidal inner pack placed inside said outer box, said inner pack including a wrapper airtightly enclosing a content of said inner pack, the wrapper having a first film layer sandwiched between a paper layer and a second film layer for heat sealing, an overlap provided at an upper location of a front face of said inner pack, the overlap being formed by folding the wrapper and having inner and outer overlap portions overlapped to each other, substantially-parallel two opening developing lines extending across a top face of said inner pack and then further extending from the top face of said inner pack to the overlap, an opening start line extending in the outer overlap portion of the overlap and connecting to the opening developing lines at both ends thereof, and a heat-sealed area formed in the overlap to surround the opening start line, by heat-sealing the inner and outer overlap portions of the overlap, wherein an outer face of the outer overlap portion is bonded to an inner face of the tongue via the to-be cutout portion, at a location above the opening start line within a region of said overlap surrounded by the heat-sealed area, the opening developing lines each is formed by making a half-cut line in the wrapper in a manner that the cut does not penetrate through the wrapper, and the opening-start line is formed by making a full-cut line through the outer overlap portion of the overlap.

2. The package according to claim 1, wherein the opening start line extends substantially in V- shape.

3. The package according to claim 1, wherein the overlap is folded down toward a bottom of said inner pack to overlie the front face of said inner pack.

4. The package according to claim 3, wherein the overlap extends in a width direction of said inner pack.

5. The package according to claim 1, wherein the wrapper further includes longitudinal fin seals provided at side faces thereof, respectively, the longitudinal fin seals extending from a top to a bottom of said inner pack.

6. The package according to claim 5, wherein the longitudinal fin seals are folded to overlie the side faces of said inner pack, respectively.

7. The package according to claim 1, wherein the first film layer is made of PET.

8. The package according to claim 1, wherein the opening developing lines have a depth reaching the first film layer via the paper layer, respectively.

* * * * *